United States Patent [19]

Holmes

[11] 4,455,896

[45] Jun. 26, 1984

[54] WRENCH STRUCTURE

[76] Inventor: Freddy Holmes, 9521 Hamilton, Belleville, Mich. 48111

[21] Appl. No.: 334,825

[22] Filed: Dec. 28, 1981

[51] Int. Cl.[3] ..... B25B 17/00

[52] U.S. Cl. ..... 81/57.26; 81/57.29; 81/59.1

[58] Field of Search ..... 81/57.29, 57.26, 177.8, 81/177 UJ, 59.1, 60, 58; 464/141, 142, 143; 403/114

[56] References Cited

U.S. PATENT DOCUMENTS

| | | | |
|---|---|---|---|
| 1,167,948 | 1/1916 | Starrett et al. | 81/177 UJ |
| 1,199,662 | 9/1916 | Campbell | 464/142 |
| 1,670,547 | 5/1928 | North | 81/177 UJ |
| 1,905,388 | 4/1933 | Lamb | 81/59.1 |
| 2,694,953 | 11/1954 | Williams | 81/57.29 |
| 2,800,821 | 7/1957 | Fruscella | 81/60 |
| 3,107,504 | 10/1963 | Koss | 464/141 |

*Primary Examiner*—James L. Jones, Jr.
*Attorney, Agent, or Firm*—Charles W. Chandler

[57] ABSTRACT

A wrench head having an input gear meshed with an output gear, and a universal joint carried on the output gear such that a nut connected to the output gear can be turned within a range of selected angles with respect to the axis of rotation of the input gear.

A ratchet wrench having a ratchet gear and a universal joint supporting a stud, attached to the ratchet gear is also disclosed.

2 Claims, 5 Drawing Figures

WRENCH STRUCTURE

BACKGROUND OF THE INVENTION

This invention is related to wrench construction, and more particularly to a wrench head having a universal joint mounted in the case and carried on one of a pair of bevel gears so that the user can turn a fastener in a wide range of angles with respect to the axis of the input turning motion.

Mechanics frequently must either loosen or tighten a bolt or a nut disposed in a relatively inaccessible location. Some socket wrenches can be connected to an extension which in turn is connected to a pair of beveled gears such that by manipulating the wrench about a first axis, a bolt mounted for rotation about another axis can be either loosened or tightened. Such a prior art wrench is illustrated in U.S. Pat. No. 2,716,363 which issued to Wasylow. Another wrench structure for changing the direction of the input torque is illustrated in U.S. Pat. No. 2,694,953 which issued to Williams. These wrench structures are generally limited to changing the direction of rotation of the user's wrench ninety degrees. They do not permit the user to change his direction of rotation at other selected angles.

SUMMARY OF THE INVENTION

The broad purpose of the present invention is to provide an improved wrench head which can be connected to a ratchet wrench or the like to permit the user to rotate the wrench about a first axis with means for connecting the output of the head to a fastener that is to be rotated about an axis at a selected angle with respect to the axis of rotation of the wrench.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
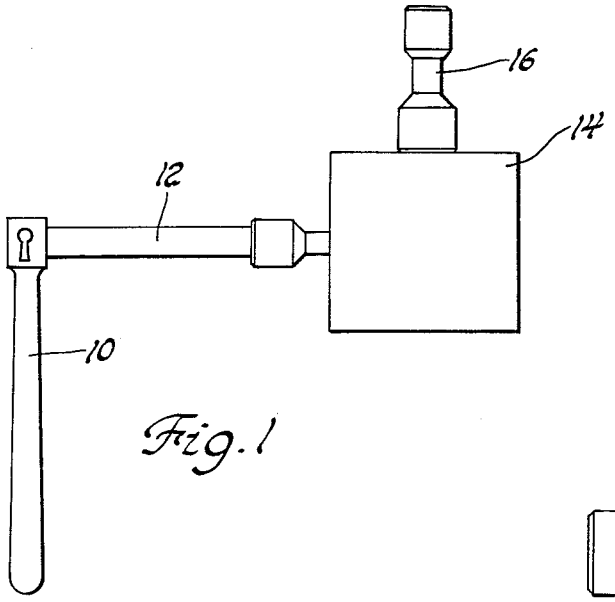
FIG. 1 illustrates a socket head wrench attached to a head illustrating the preferred embodiment of the invention.

Referring to the drawing, FIG. 1 illustrates a conventional ratchet wrench 10 connected to an extension 12 which is operatively engaged with a head 14. The output of head 14 is connected to an extension 16 suited for engaging a nut (not shown).

Figure 2:
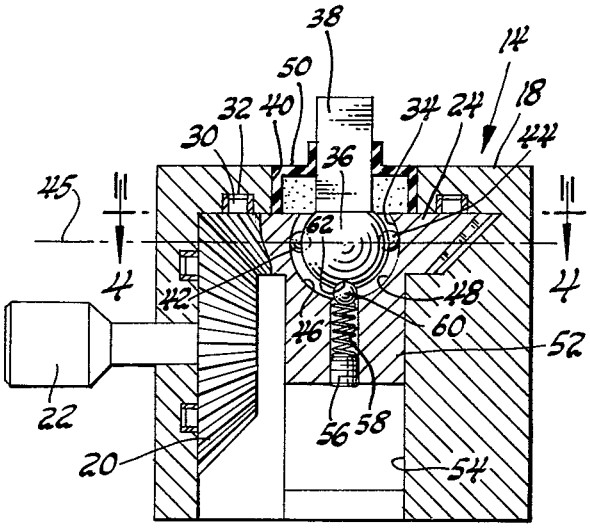
FIG. 2 is an enlarged sectional view through the preferred wrench head.
Figure 3:
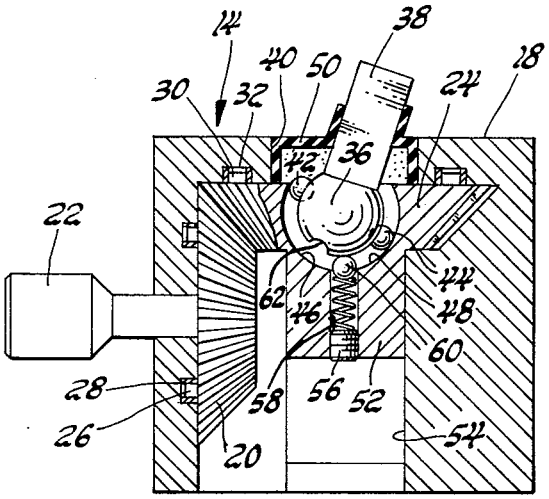
FIG. 3 is a sectional view similar to FIG. 2 but showing the output stud tilted at a selected angle with respect to the input socket.
Figure 4:
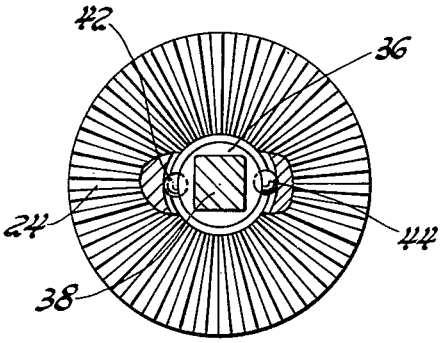
FIG. 4 is a view as seen along lines 4—4 of FIG. 2.

Referring to FIG. 2, head 14 comprises a body or case 18. A bevel gear 20 is rotatably mounted in case 18, and has a female hexagonal socket 22 for receiving extension 12 in the manner well know to those skilled in the art.

A second bevel gear 24 is mounted in case 18 and meshed with gear 20 in such a manner that as gear 20 is being rotated, gear 24 is also rotated.

Gear 20 has an annular element 26 engaged with bushing 28 for stabilizing the gear as it is being rotated. Similarly, gear 24 has an annular stabilizing element 30 engaged with bushing 32 for stabilizing gear 24 as it is being rotated. Gear 24 is rotatable about an axis that is at right angles to the axis of rotation of bevel gear 20.

Gear 24 has a partially speherical opening 34. A ball-shaped joint member 36 is mounted in opening 34. A stud 38 is carried by joint member 36 and extends through an opening 40 of case 18. A pair of balls 42 and 44 are carried on opposite sides of joint member 36 in such a manner that the joint member is pivotable about an axis 45 defined by the position of balls 42 and 44.

Gear 24 has a pair of opposed grooves 46 and 48 on opposite sides of opening 34 for receiving balls 42 and 44, respectively. Thus, joint member 36 is rotatable about an axis defined by grooves 46 and 48 at right angles to axis 45. The arrangement is such that the joint member is movable about a pair of mutually perpendicular axes so that as gear 24 is rotated, joint member 36 is rotated with the gear in such a manner that stud 38 maintains its relative position with respect to body 18. Thus the stud can be located in a selected angle of a range of angles with respect to the turning axis of input socket 22.

This arrangement permits the user to turn socket 22 in a first rotary direction while permitting the output stud 38 to be rotated about a second axis at a selected angle with respect to the axis of rotation of socket 22. Stud 38 can be detachably connected to extension 16, as illustrated in FIG. 1.

Flexible boot means 50 mounted on opening 40 protects the interior of the case from foreign matter and the like.

It is to be noted that bevel gear 20 has fewer teeth than bevel gear 24 so as to reduce the output rate of rotation of stud 38 and increase the output torque.

Gear 24 has a base 52 received in opening 54 of the case for stabilizing the rotation of the gear. A plug 56 is mounted in an opening 58 for adjusting the tension of a spring-loaded detent 60 which engages an opening 62 of the joint member to indicate to the user when stud 38 is at a ninety degree angle with respect to the turning axis of socket 22.

Obviously different types of gears can be used instead of bevel gears to provide a stronger and more compact head construction. In addition, balls 42 and 44 can be replaced by a pin that passes through joint member 36, with its opposite ends having a rounded shape.

Furthermore, it is to be understood that the joint construction illustrated can be used to provide a universal joint for other types of tools such as a ratchet head.

Figure 5:
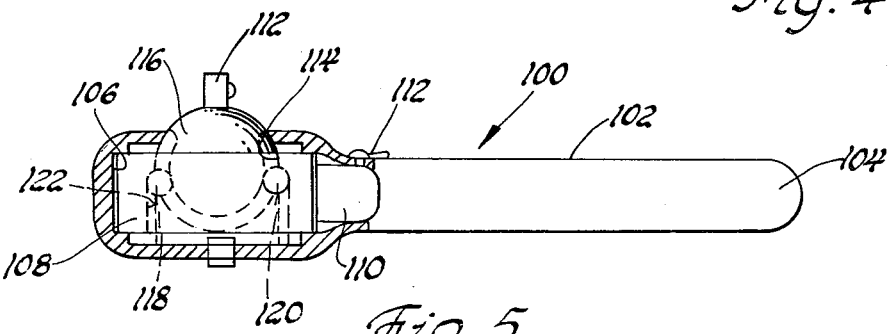
FIG. 5 is a sectional view of a ratchet head wrench having a universal joint in accordance with the invention.

FIG. 5 illustrates another embodiment of the invention incorporated in a ratchet wrench generally indicated at 100 having an elongated case 102. One end of the case functions as a handle 104 in the conventional manner. The other end of the case has an opening 106. A ratchet gear 108 is mounted in the opening. A pawl 110 is carried in the case and engaged with gear 108 in such a manner as to limit the direction of rotation of the gear depending upon the position of a finger 112 connected to the pawl and manipulated by the user in the manner well known to those skilled in the art.

Gear 108 has an opening 114. A ball-shaped joint member 116 is mounted in the opening. A pair of balls 118 and 120 are carried on diametrically opposite sides of the joint 116 to form pivot elements. Balls 118 and 120 are received in groove 122 in the ball so that the joint 116 and balls 118 and 120 can be moved about a second axis with respect to gear 108. A stud 126 is carried on the joint member for attaching a conventional socket, or extension or the like (not shown) for either loosening or tightening a fastener, such as a nut.

This embodiment permits the user to turn the handle 104 about the axis of rotation of gear 108 in order to either loosen or tighten a nut that is turned about an axis that is at a selected angle with respect to the axis or rotation of the handle. It thus permits the user to engage or disengage a fastener located in a relatively inaccessible location without the use of the conventional externally mounted universal joint.

Having described my invention, I claim:

1. A wrench structure, comprising:

a body having a first opening and a second opening;

a first bevel gear member nested in said body adjacent said first opening so as to be rotatable in either a first rotary direction with respect to the body, or in the opposite rotary direction, the first gear member having an annular array of teeth, and a partially spherical opening;

a partially spherical joint member mounted in the first gear member opening;

each of said members having groove means;

a pair of balls, slideably disposed in said groove means between the first gear member and the joint member and on opposite sides of the joint member whereby the joint member is pivotal with respect to the first gear member about an axis passing through the pair of balls, and is rotatable with respect to the body in a second rotary direction defined by the groove means;

the joint member being movable with the first gear member at such times as the first gear member is being moved in either said first rotary direction, or in said opposite direction;

stud means carried by the joint member in the first body opening for releaseably connecting a wrench member;

a second bevel gear member rotatably mounted in the body adjacent the second body opening, the second gear member being meshed with the first gear member so as to rotate same at such times as the second gear member is being rotated;

means mounted in the second body opening and connected to the second gear for rotating same such that the stud means can be turned within a range of selected angles with respect to the axis of rotation of the second gear member; and spring biased detent means mounted in the body and engaged with the joint member to releasably lock same in a predetermined position with respect to the body.

2. A wrench structure, comprising:

a body having an elongated handle, and an opening;

a gear member nested in said opening so as to be rotatable in either a first rotary direction with respect to the body, or in the opposite rotary direction, the gear member having an annular array of teeth, and a partially spherical opening;

a partially spherical joint member mounted in the gear member opening;

each of said members having groove means;

a pair of balls disposed in substantial alignment with the longitudinal axis of the handle, and slideably disposed in said groove means between the gear member and the joint member and on opposite sides of the joint member whereby the joint member is pivotal with respect to the gear member about an axis passing through the pair of balls, and is rotatable with respect to the body in a second rotary direction defined by the groove means;

the joint member being movable with the gear member at such times as the gear member is being moved in either said first rotary direction, or in the opposite direction;

pawl means for engaging the gear member teeth such that the joint member rotates with the handle as it is being rotated in a first direction, and the joint member rotates with respect to the handle at such times as the handle is being rotated in the opposite direction; and stud means carried by the joint member in said body opening for releaseably connecting a wrench member to the joint member.

* * * * *